US006416353B1

(12) United States Patent
Hwang et al.

(10) Patent No.: US 6,416,353 B1
(45) Date of Patent: Jul. 9, 2002

(54) CONNECTOR ASSEMBLY HAVING ROTATABLE PULL MECHANISM

(75) Inventors: Jenq-Yih Hwang; George Lee, both of Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/812,538

(22) Filed: Mar. 19, 2001

(51) Int. Cl.[7] ..... H01R 13/00
(52) U.S. Cl. ..... 439/484
(58) Field of Search ..... 439/456, 459, 439/483, 484, 404, 405

(56) References Cited

U.S. PATENT DOCUMENTS 6,074,237 A * 6/2000 Lee ..... 439/405
6,126,479 A * 10/2000 Lee ..... 439/484
6,132,241 A * 10/2000 Hwang ..... 439/405

* cited by examiner

*Primary Examiner*—Gary Paumen
(74) *Attorney, Agent, or Firm*—Wei Te Chung

(57) ABSTRACT

An electrical connector assembly (1, 1') includes an electrical connector (3, 3'), a dielectric cover (5, 5') coupled to the electrical connector and a pull mechanism (7, 7'). The pull mechanism includes a locking mechanism locked with both the electrical connector and the dielectric cover and a pull leash (70, 70') assembled to the locking mechanism. The pull leash is rotatable on the locking mechanism.

1 Claim, 12 Drawing Sheets

CONNECTOR ASSEMBLY HAVING ROTATABLE PULL MECHANISM

BACKGROUND OF THE INVENTION

1. Field of the Invention

The present invention relates to an electrical connector assembly, and particularly to an electrical cable connector assembly having a pull mechanism to facilitate disengaging the electrical cable connector assembly from a mating complementary electrical connector.

2. Description of the Related Art

A conventional electrical cable connector assembly for a flat cable usually comprises an electrical connector including electrical contacts, each having an engaging end for engaging with a corresponding conductor of a flat cable by Insulation Displacement Connection (IDC) and a mating end for mating with electrical contacts of a complementary electrical connector. A dielectric cover presses the flat cable to a top of the electrical connector. In addition, a pull mechanism is usually provided for users to disengage the electrical cable connector assembly from a mating complementary electrical connector where a low profile electrical cable connector assembly is concerned. The low profile electrical connectors comply with miniaturization trends in the electronic field but access for users to disengage a low profile electrical cable connector assembly from a mating complementary electrical connector is often difficult.

The pull mechanism usually stands along a vertical direction above a top of the dielectric cover and the electrical connector of the electrical cable connector assembly, which inevitably increases the total height of the mated electrical cable connector assembly and complementary electrical connector and which runs counter to the initial design vision of low profile electrical connectors.

Therefore, an electrical cable connector assembly having an improved pull mechanism is required to overcome the disadvantages described above.

SUMMARY OF THE INVENTION

A major object of the present invention is to provide an electrical cable connector assembly having a pull mechanism, which facilitates users to disengage the electrical cable connector assembly from a mating complementary electrical connector without increasing the total height of the mating electrical cable connector assembly and complementary electrical connector.

To fulfill the above object, an electrical cable connector assembly in accordance with the present invention comprises an electrical connector, a dielectric cover and a pull mechanism. The electrical connector comprises an elongated insulative housing comprising a pair of opposite ends and a plurality of electrical contacts mounted between the opposite ends of the insulative housing.

The dielectric cover comprises a pair of cover ends and defines a lower surface having a configuration corresponding to a flat cable to tightly press the flat cable to the electrical connector and to reliably position electrical conductors of the flat cable for ensuring a reliable electrical Insulation Displacement Connection (IDC) between the electrical conductors and the electrical contacts.

The pull mechanism comprises a locking mechanism and a pull leash assembled to the locking mechanism. The locking mechanism is assembled to both the cover ends of the dielectric cover and the opposite ends of the insulative housing. The pull leash is rotatable on the locking mechanism from a first position where a leash body thereof stands above an upper surface of the dielectric cover to a second position where the leash body is positioned flush with or lower than the upper surface of the dielectric cover.

Other objects, advantages and novel features of the invention will become more apparent from the following detailed description of the present embodiment when taken in conjunction with the accompanying drawings.

DETAILED DESCRIPTION OF THE INVENTION

Figure 1:
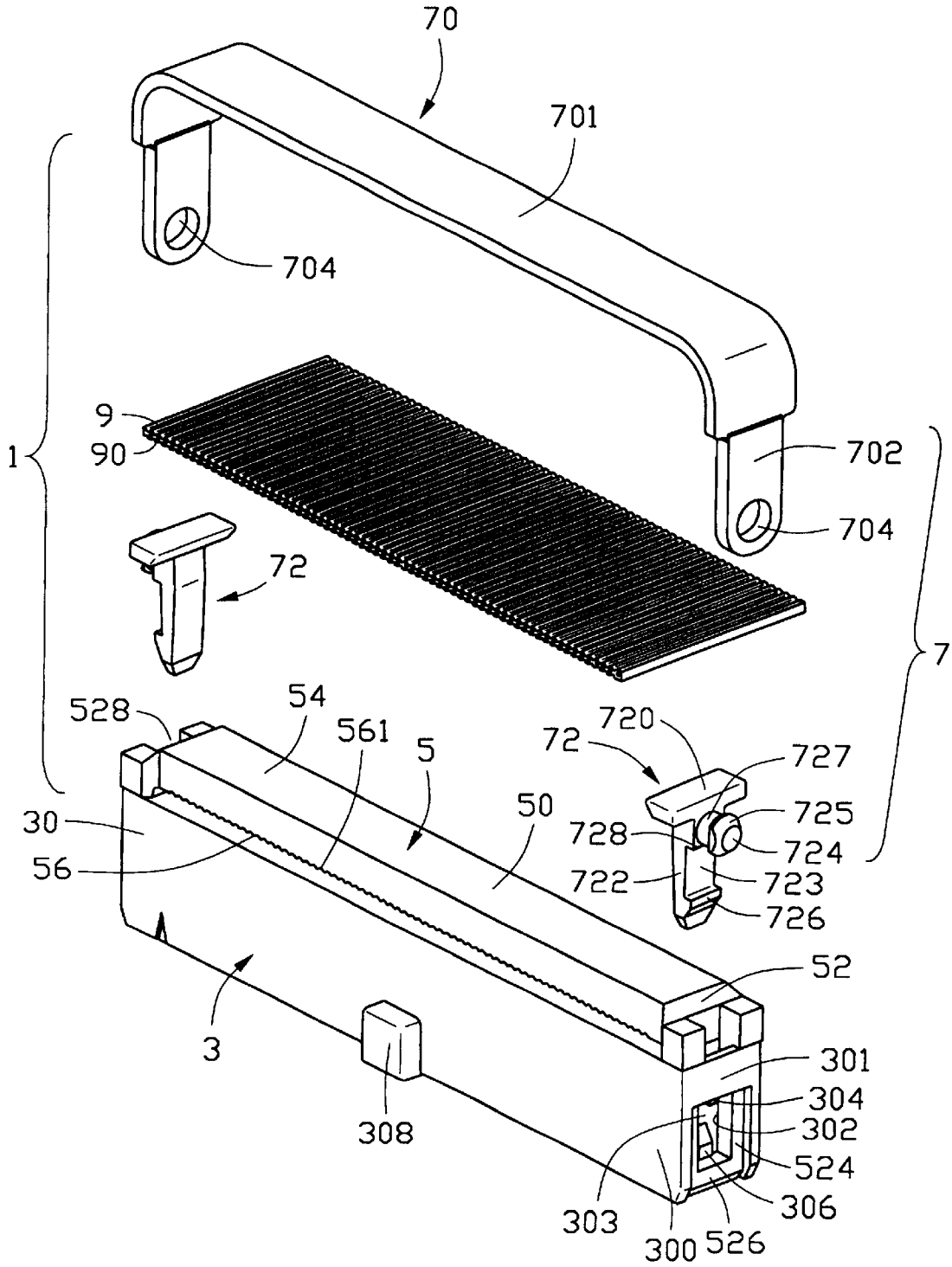
FIG. 1 is a partially exploded view of an electrical cable connector assembly for a flat cable in accordance with a first embodiment of the present invention.
Figure 2:
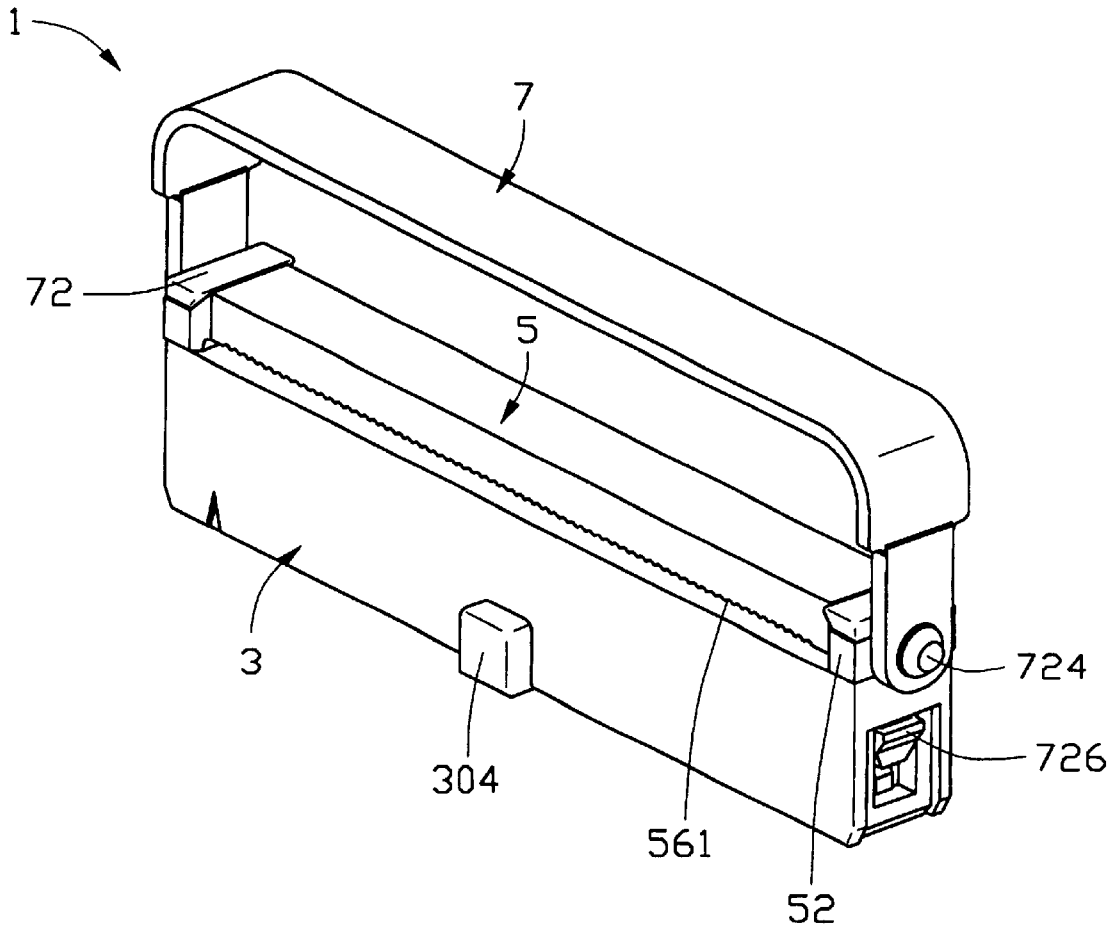
FIG. 2 is an assembled perspective view of FIG. 1 with the flat cable being omitted herefrom for clarity and a pull leash of the electrical cable connector assembly being positioned at an operating position.
Figure 3:
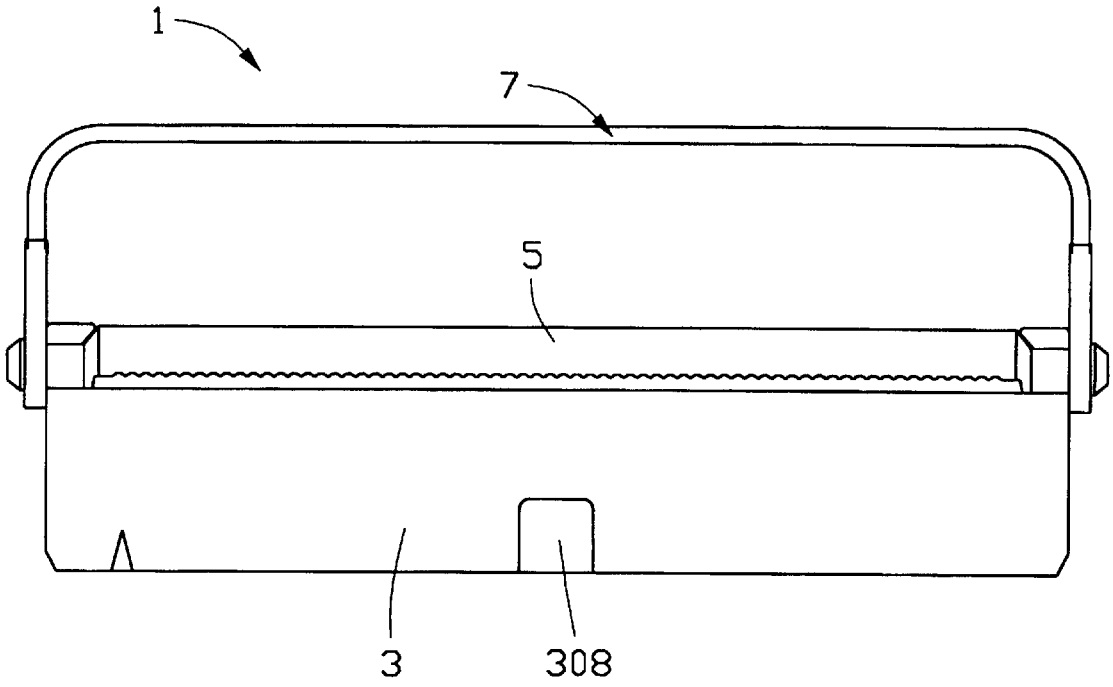
FIG. 3 is an enlarged front view of FIG. 2.
Figure 4:
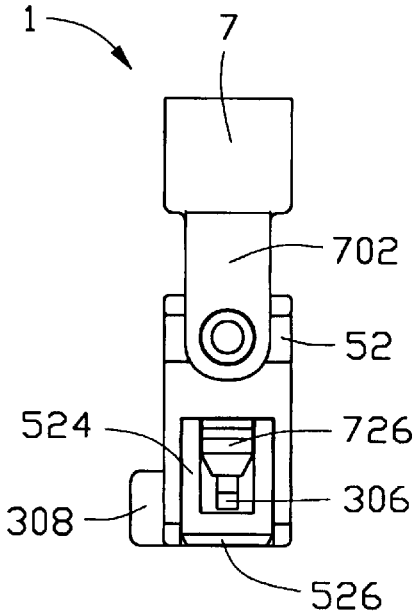
FIG. 4 is a side elevation view of FIG. 3.

Referring to FIG. 1, an electrical cable connector assembly 1 in accordance with a first embodiment of the present invention comprises an electrical connector 3, a dielectric cover 5 securing a flat cable 9 to the electrical connector 3, and a pull mechanism 7.

The electrical connector 3 comprises an elongated insulative housing 30 and a plurality of electrical contacts 32 (not shown). The insulative housing 30 comprises a pair of opposite ends 300, each of which defines a slot 302 extending from an upper section into a lower section thereof. An inner wall 303 of each slot 302 forms a pair of barbs 304 and an inverted wedge-shaped projection 306 below the barbs 304 thereon. An outer wall 301 of each slot 302 exposes outwardly the slots 302 at lower sections thereof, whereby the barbs 304 and the projection 306 on the inner wall 303 are positioned therebelow in a vertical direction and are viewable from outside thereof. A block 308 protrudes outwardly from midway a lower portion of a longitudinal side of the insulative housing 30 to provide a fool-proof mating function to the electrical cable connector assembly 1. The electrical contacts 32 are mounted in the insulative housing 30 between the opposite ends 300 in a manner known to persons skilled in the Insulation Displacement Connection electrical connector art.

The dielectric cover 5 comprises a pair of cover ends 52 and an elongated plate shaped main body 50 therebetween. The main body 50 defines an upper surface 54 and a lower surface 56 opposite to the upper surface 54. The lower surface 56 defines a plurality of recesses 561 configured corresponding to the shape of electrical conductors 90 of the flat cable 9 to properly position the electrical conductors 90. The pair of cover ends 52 each comprise a pair of shoulders 522 positioned at opposite ends of the main body 50, a pair of bars 524 depending respectively from the shoulders 522 and a bottom bar 526 extending between and connecting bottoms of the bars 524.

The pull mechanism 7 comprises an arch pull leash 70 and a locking mechanism comprising a pair of generally T-shaped locking tabs 72. The pull leash 70 is made of high performance plastic material, such as Nylon, and comprises a longitudinal leash body 701 and a pair of extensions 702 formed at two opposite ends of the leash body 701. The extensions 702 each define a circular hole 704 therein. The locking tabs 72 each comprise a rib 720, a leg 722 depending downwardly from midway of the rib 720, and a head 724 protruding outwardly from an upper section 728 of the leg 722 proximate to the rib 720. The legs 722 each form a hook section 726 at bottom sections thereof. A recess 723 is defined between the upper section 728 and the hook section 726 of each leg 722. The head 724 is generally cylindrical and comprises a neck section 727 perpendicularly extending from the upper section 728 and an enlarged section 725 extending from the neck section 727 and having a diameter larger than the neck section 727 and the holes 704 of the extensions 702 of the pull leash 70. The diameters of the neck sections 727 are a little smaller than the diameters of the holes 704 and the lengths of the neck sections 727 are substantially equal to the thicknesses of the extensions 702 of the pull leash 70.

In assembly, the flat cable 9 is put on the insulative housing 30. The dielectric cover 5 is then pressed to the insulative housing 30 to cause the electrical contacts 32 to have an Insulation Displacement Connection (IDC) with the electrical conductors 91 of the flat cable 9, wherein the electrical contacts 32 and the electrical conductors 91 are respectively received in the recesses 561. The bars 524 and the bottom bars 526 of the cover ends 52 are inserted into the slots 302 of the insulative housing 30 until the bottom bars 526 slide over the wedge-shaped projections 306. The shoulders 522 of each cover end 52 are partially supported by the outer walls 301 of the slots 302 and define a cavity 528 therebetween communicating with the slots 302 of the insulative housing 30. Thus, the electrical connector 3 and the dielectric cover 5 are fixedly connected together with the projections 306 of the insulative housing 30 preventing the upward movement of the dielectric cover 5.

The legs 722 of the locking tabs 72 are inserted through the cavities 528 between the shoulders 522 of the cover ends 52 of the cover 5 into the slots 302 of the insulative housing 30 until the ribs 720 abut against the shoulders 522. The upper sections 728 of the legs 722 are located in the cavities 528 with the head 724 protruding laterally beyond the shoulders 522 of the cover ends 52 and the outer walls 301 of the ends 300 of the insulative housing 30. The outer walls 301 of the insulative housing 30 are fitted in the recesses 723 of the legs 722, thereby restraining the locking tabs 72 from moving in vertical direction by the outer walls 301 of the insulative housing 30 and the shoulders 522 of the cover ends 52. The barbs 304 enforce a reliable interferential retention therebetween by providing an outward pressing force to lower sections of the legs 722.

The holes 704 of the extensions 702 of the pull leash 70 receive the neck sections 727 of the heads 724 and the pull leash 70 is restrained from escaping from the locking tabs 72 due to the larger diameters of the enlarged sections 725 than the neck sections 727 and the holes 704. The pull leash 70 is rotatable on the neck sections 727 of the locking tabs 72.

Figure 9:
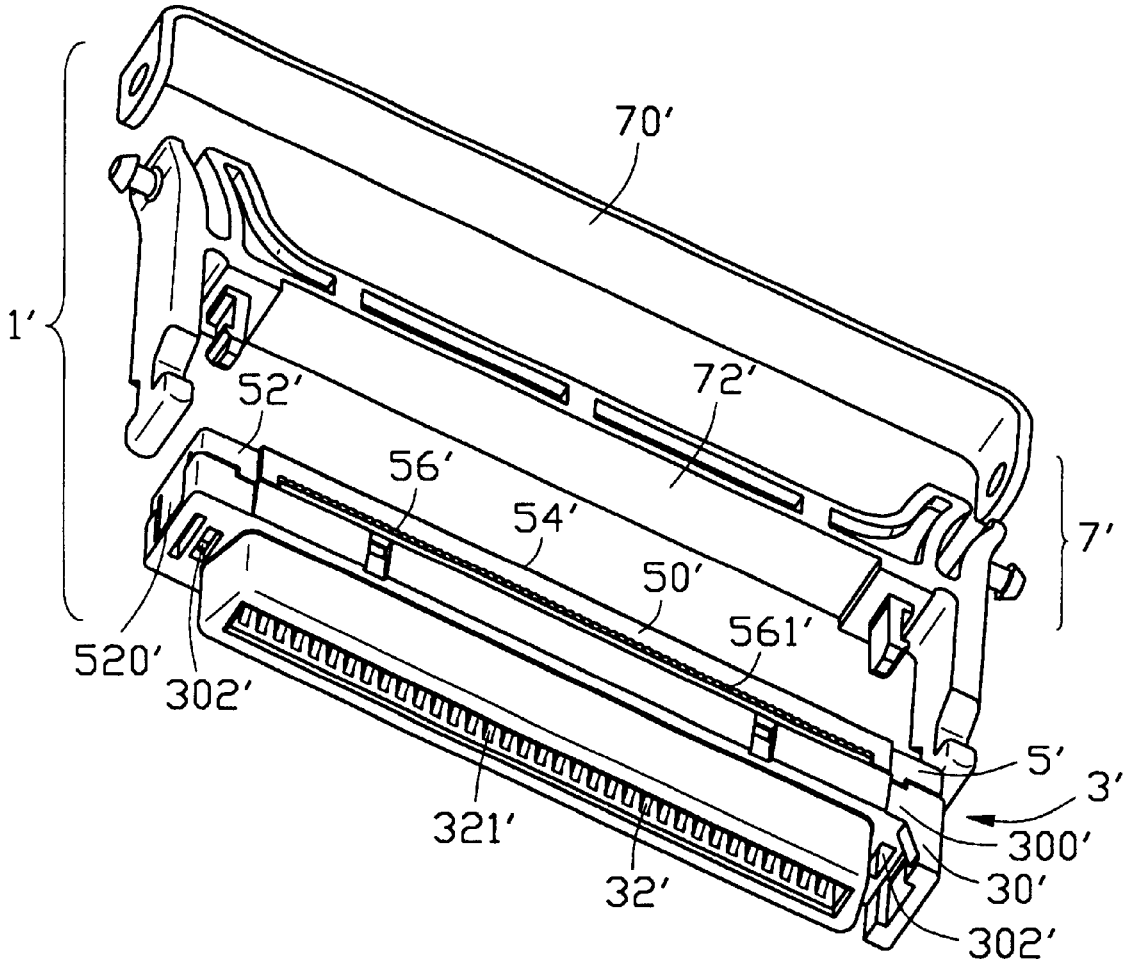
FIG. 9 is a partially exploded view of an electrical cable connector assembly in accordance with a second embodiment of the present invention.
Figure 10:
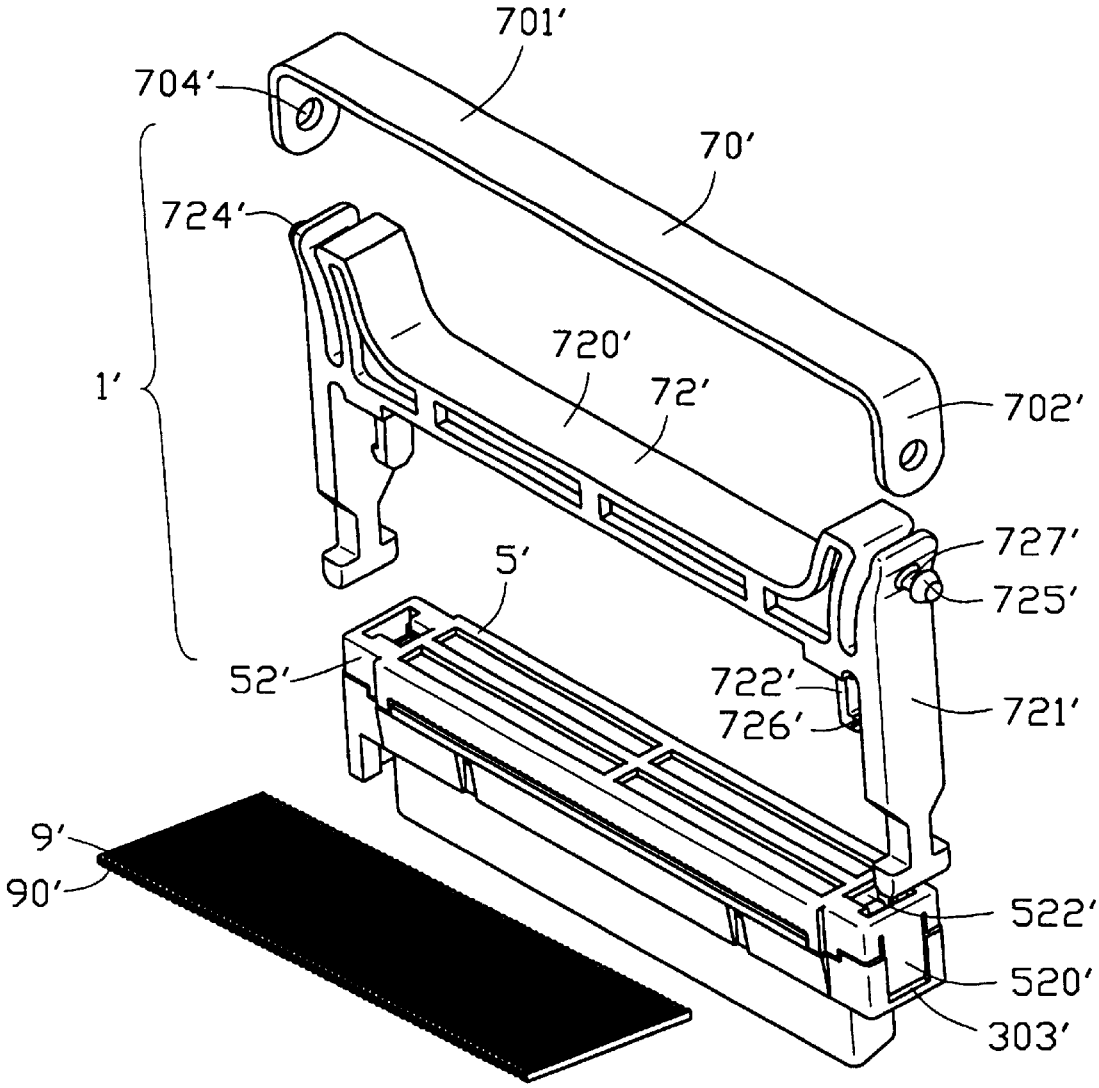
FIG. 10 is similar to FIG. 9 but viewed from another perspective with a flat cable shown herein.
Figure 11:
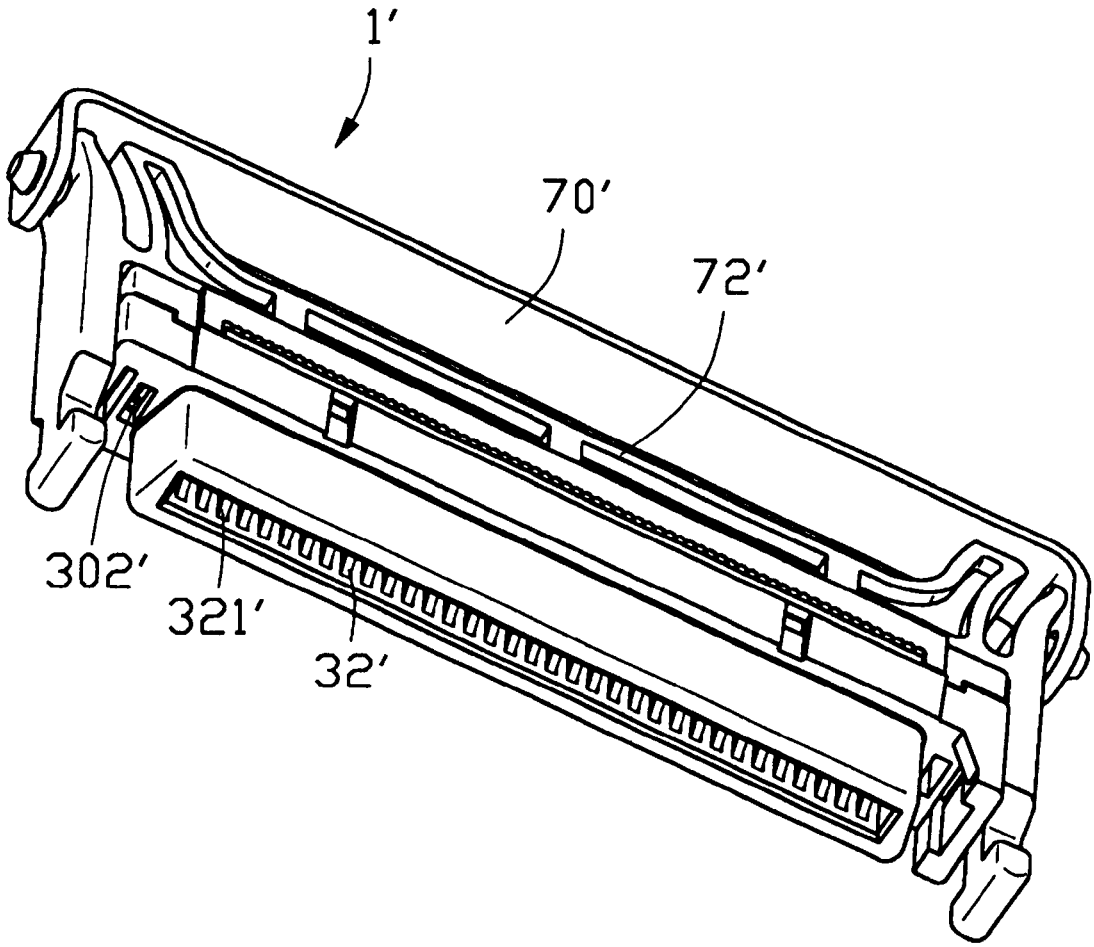
FIG. 11 is an assembled view of FIG. 9 with the a pull leash thereof being positioned in the operating position.
Figure 12:
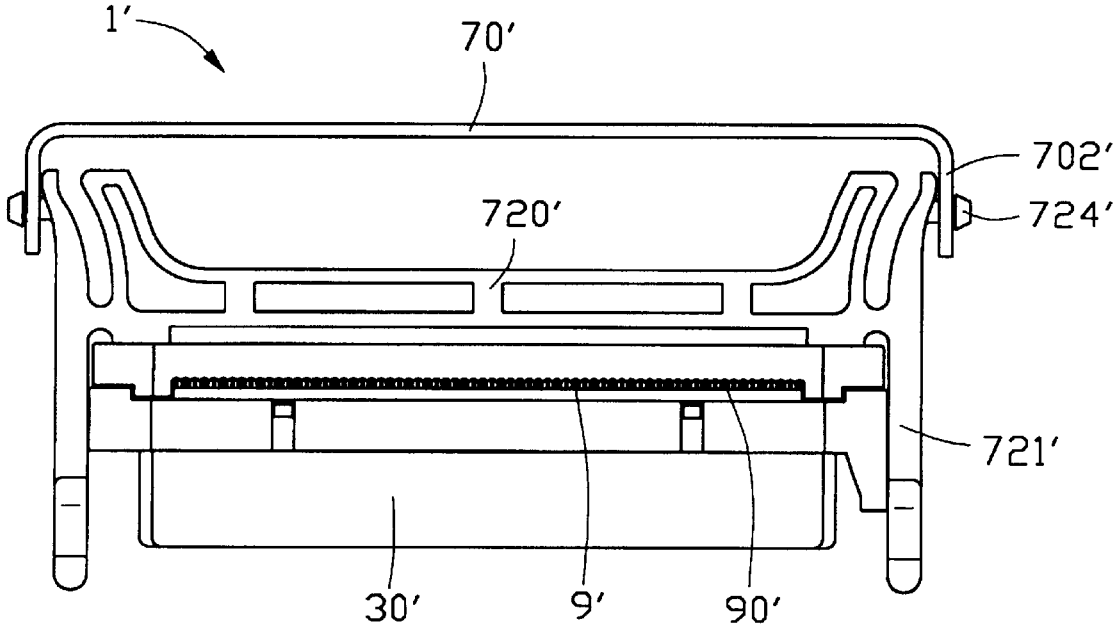
FIG. 12 is a front view of FIG. 11.

Referring to FIGS. 9 and 10, an electrical cable connector assembly 1' in accordance with a second embodiment of the present invention comprises an electrical connector 3', a dielectric cover 5' for coupling an electrical flat cable 9' (FIG. 10) to the electrical connector 3' and a pull mechanism 7'. The electrical connector 3' comprises an elongated insulative housing 30' and a plurality of electrical contacts 32'. The insulative housing 30' comprises a pair of opposite ends 300', each of which defines a slot 302' extending therethrough and a cutout 303' recessed from an upper and outer face thereof. The electrical contacts 32' are mounted in the insulative housing 30' between the opposite ends 300'. Each electrical contact 32' comprises a mating end 321' and an engaging end 322' (not shown).

The dielectric cover 5' comprises a pair of cover ends 52' and a main body 50' therebetween. The main body 50' comprises an upper surface 54' and a lower surface 56' opposite to the upper surface 54'. The lower surface 56' defines a plurality of recesses 561' configured to correspond to the shape of electrical conductors 90' of the flat cable 9' to properly position the electrical conductors 90'. The pair of cover ends 52' each comprise a cavity 522' extending therethrough and a cover lid 520' depending downwardly from distal edges thereof.

The pull mechanism 7' comprises a pull leash 70' and a locking mechanism comprising a locking element 72'. The pull leash 70' is made of high performance plastic material, such as Nylon, and comprises a leash body 701' and a pair of extensions 702' formed at two opposite ends of the leash body 701'. The extensions 702' each define a circular hole 704' therein. The locking element 72' comprises a rib 720', a pair of arms 721' extending at opposite ends of the rib 720', a pair of legs 722' extending downwardly from a lower surface of opposite ends of the rib 720' and a pair of heads 724' protruding outwardly from an upper section of each arm 721'. The legs 722' are positioned adjacent to and spaced from the arms 721', respectively, and each form a hook section 726' at lower sections thereof. The heads 724' are generally cylindrical and each comprise an enlarged section 725' and a neck section 727' extending between the enlarged section 725' and the arm 721'. The neck sections 727' have diameters substantially equal to the holes 704' of the pull leash 70' and smaller than the enlarged section 725'.

In assembly, the flat cable 9' is put on the insulative housing 30'. The cover 5' is then pressed to the insulative housing 30' to cause the engaging ends 322' of the electrical contacts 32' to have an IDC with electrical conductors 91' of the flat cable 9', wherein the engaging ends 322' and electrical conductors 91' are respectively received by the recesses 561'. The cover lids 520' of the cover 5' are inserted into the cutouts 303' of the insulative housing 30' and are retained thereto in ordinary ways known to persons skilled in the pertinent art. The cavities 522' of the cover ends 52' are in communication with the slots 302' of the insulative housing 30'. Thus, the electrical connector 3' and the dielectric cover 5' are connected together.

The legs 722' of the locking element 72' are inserted through the cavities 522' of the cover ends 52' of the dielectric cover 5' into the slots 302' of the insulative housing 30. The hook sections 726' provide an interferential retention between the locking element 72', the cover 5' and the insulative housing 30'. The arms 721' abut against outside faces of the cover ends 52' of the cover 5' and the opposite ends 300' of the insulative housing 30' and extend beyond a bottom of the insulative housing 30'. The holes 704' of the extensions 702' of the pull leash 70' receive the neck sections 727' of the heads 724' and the pull leash 70' is restrained from escaping due to the larger dimensions of the enlarged section 725' than the necksections 727'. The pull leash 70' is pivotable about the neck sections 727' of the heads 724'.

Figure 5:
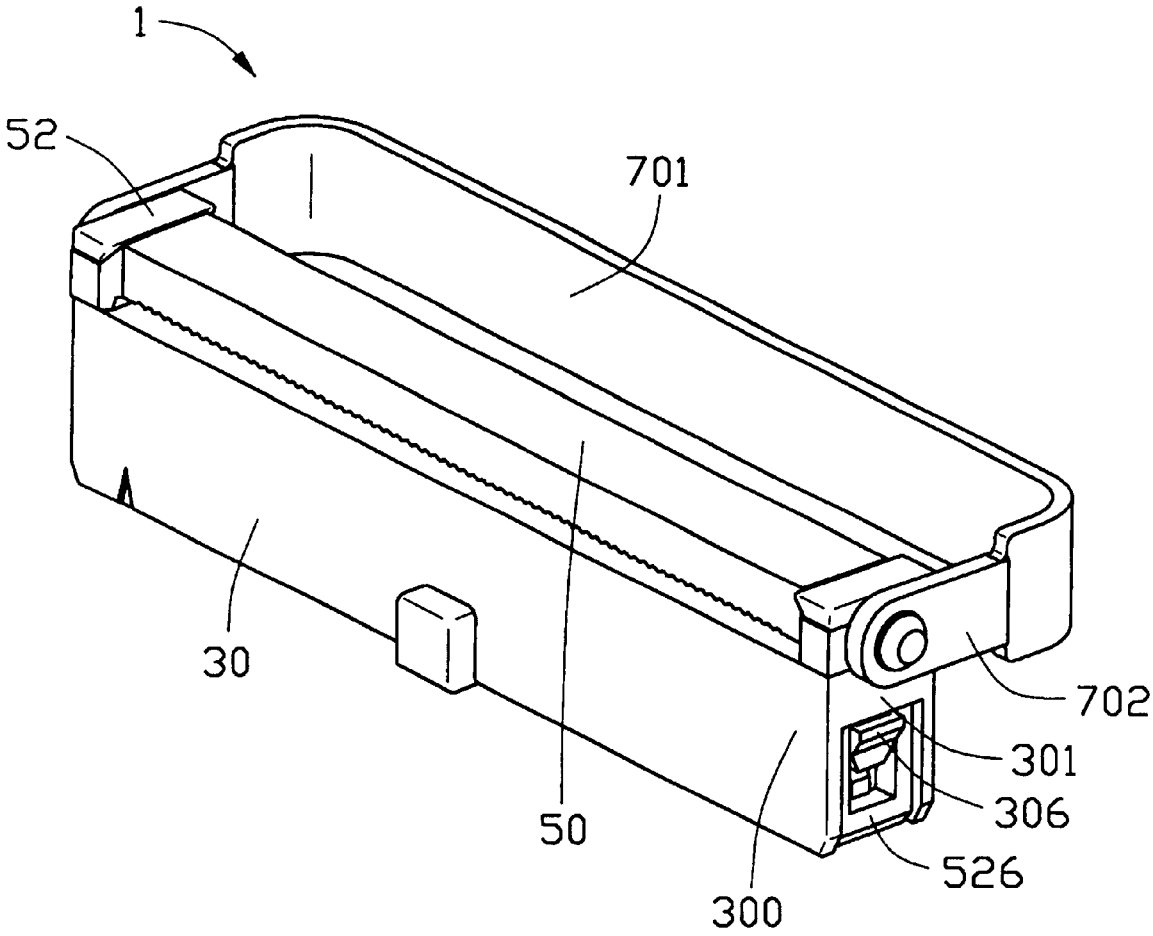
FIG. 5 is similar to FIG. 2, but the pull leash is positioned at a resting position.
Figure 6:
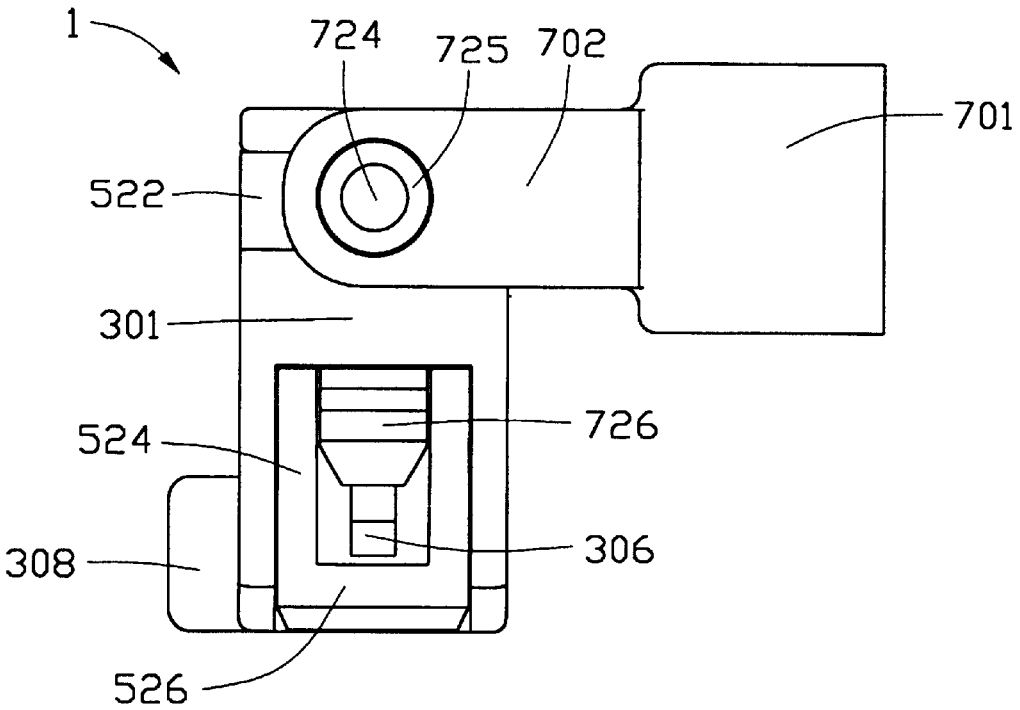
FIG. 6 is an enlarged side elevation view of FIG. 5.
Figure 7:
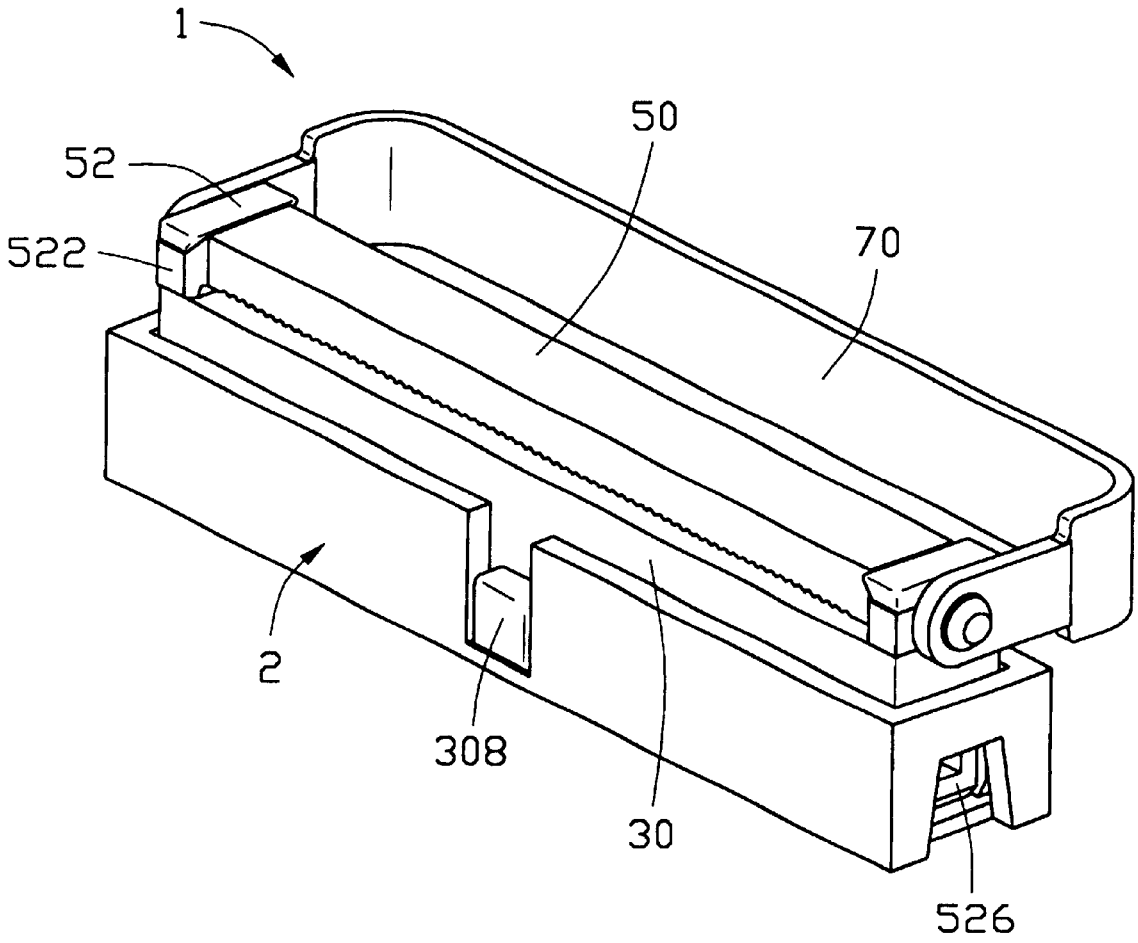
FIG. 7 is similar to FIG. 5, but the electrical cable connector assembly is mated with a complementary electrical connector.
Figure 13:
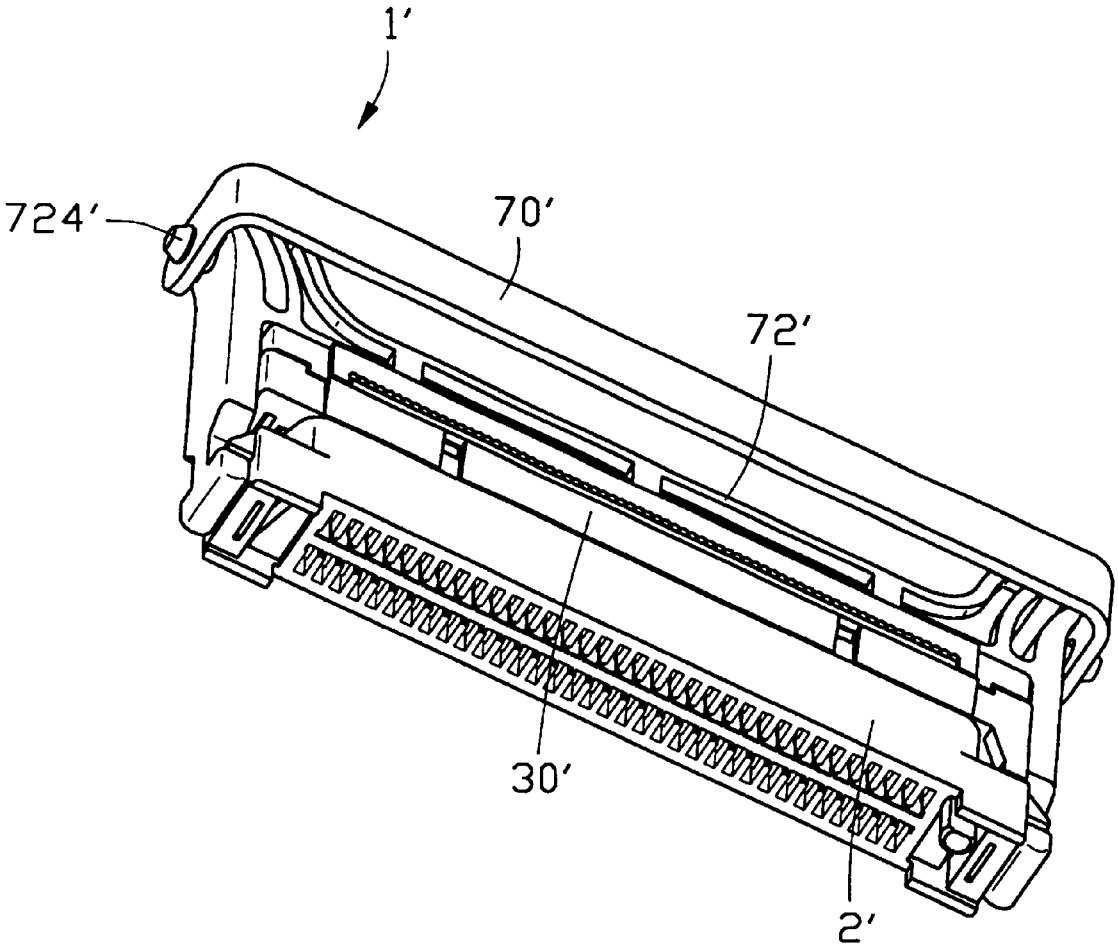
FIG. 13 is similar to FIG. 11 but the electrical cable connector assembly is mated with a complementary electrical connector and the pull leash thereof is positioned at the resting position.
Figure 14:
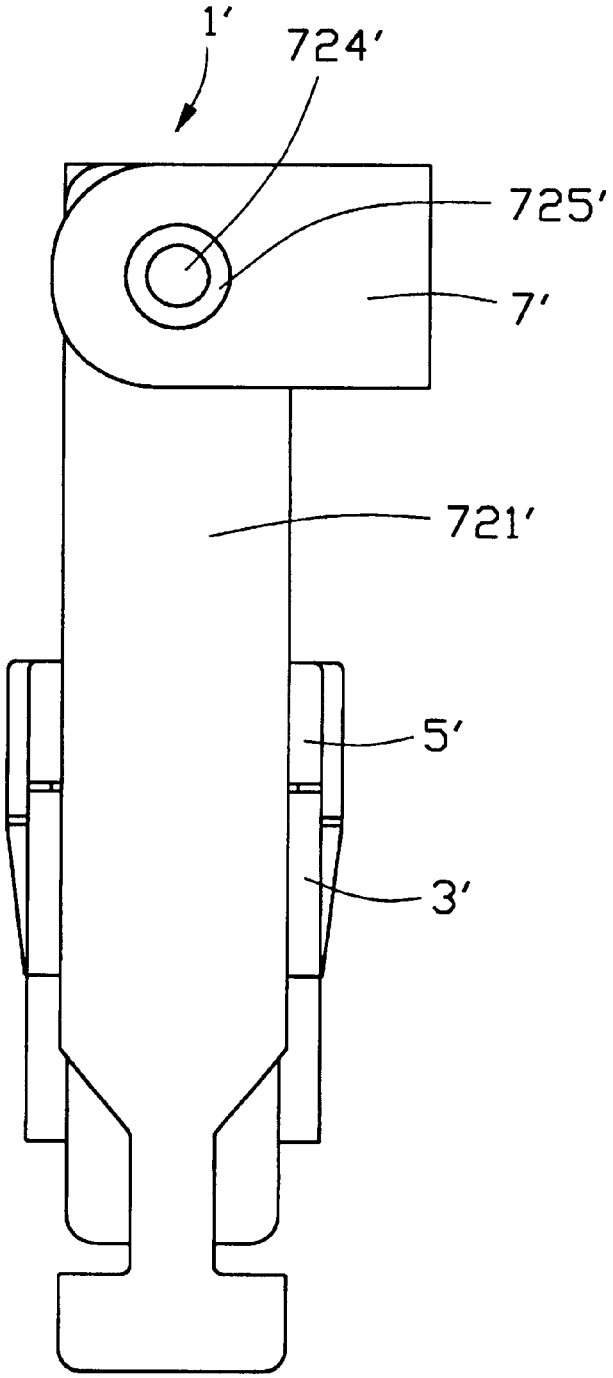
FIG. 14 is an enlarged side elevation view of the electrical cable connector assembly with the pull leash being positioned at the resting position.

In use, the pull leash 70, 70' of the electrical connector assembly 1, 1' is rotatable from an operating position as shown in FIGS. 2–4 and 11–12 where the leash body 701, 701' is located in line with the dielectric cover 5, 5' and the electrical connector 3, 3' and above the upper surface 54, 54' of the dielectric cover 5, 5' to a resting position as shown in FIGS. 5, 6 and 14 where the leash body 701, 701' is perpendicular to the dielectric cover 5, 5' and the electrical connector 3, 3' and is substantially flush with the upper surface 54, 54' of the dielectric cover 5, 5'. Referring to FIGS. 7 and 13, when the electrical connector assembly 1, 1' is mating with a complementary electrical connector 2, 2' and the electrical contacts 32, 32' electrically contact with electrical contacts of the complementary electrical connector 2, 2', the pull leash 70, 70' is positioned at the resting position as desired whereby a vertical height of the mated electrical cable connector assembly 1, 1' and the complementary electrical connector 2, 2' is reduced.

Figure 8:
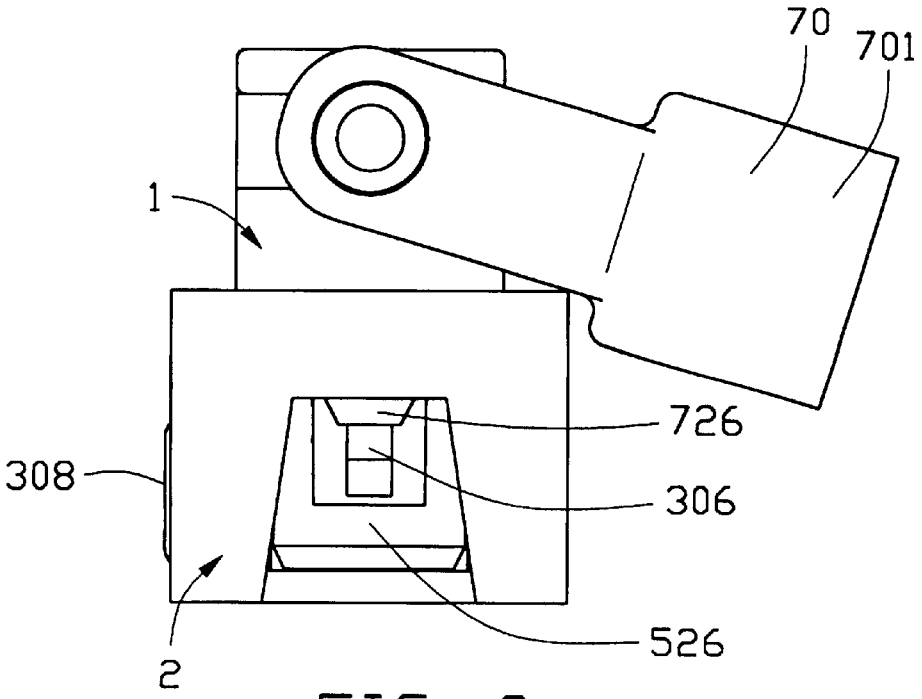
FIG. 8 is an enlarged side elevation view of the mated electrical cable connector assembly and complementary electrical connector of FIG. 7 with the pull leash being further rotated downwardly from the resting position.

Referring to FIG. 8, the pull leash 70 is as desired moved further downwardly from the resting position until it is stopped by the complementary electrical connector 2 and the leash body 701 is located lower than the upper surface 54 of the dielectric cover 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly for connecting a flat cable with a complementary electrical connector, comprising:

an electrical connector comprising an insulative housing and a plurality of electrical contacts, the insulative housing comprising a pair of opposite ends, the electrical contacts being mounted in the insulative housing between the opposite ends thereof;

a dielectric cover for coupling a flat cable to the electrical connector; and a pull mechanism comprising a locking mechanism locked with both the insulative housing and the dielectric cover, and a pull leash rotatably assembled to the locking mechanism;

wherein the dielectric cover comprises a pair of cover ends and a main body therebetween, each cover end comprising a pair of shoulders defining a cavity therebetween, a pair of bars depending respectively downwardly from the shoulders and a bottom bar connecting the bars, and wherein each opposite end of the insulative housing defines a slot therein to receive the bars and the bottom bar of the cover end;

wherein each slot comprises an inner wall forming a projection thereon and an outer wall exposing the slots outwardly at lower sections thereof, the projection being located above and abutting against the bottom bar of the cover end and the outer wall of the slot partially supporting the shoulders of the cover end;

wherein the locking mechanism comprises a pair of locking tabs, each locking tab comprising a rib supported by the shoulders of the cover end, a leg depending downwardly from the rib and received in the cavity between the shoulders of the cover end and in the slot of the opposite end of the insulative housing, and a head protruding outwardly from an upper section of the leg;

wherein the head of the locking tab is generally cylindrical and comprises a neck section and an enlarged section having a diameter larger than the neck section, and wherein the pull leash comprises a leash body and a pair of extensions each defining a circular hole having a diameter smaller than the diameter of the enlarged section to rotatably receive the neck section of the head;

wherein each leg forms a hook section thereon, the hook section and the upper section of the leg together defining a recess therebetween receiving the outer wall of the slot of the insulative housing.

* * * * *